United States Patent [19]

Kilkelly

[11] Patent Number: 4,548,327

[45] Date of Patent: Oct. 22, 1985

[54] POLE ASSEMBLY FOR INSTALLING CLOSET SHELVES

[75] Inventor: John Kilkelly, Ocala, Fla.

[73] Assignee: Clairson International Corporation, Ocala, Fla.

[21] Appl. No.: 548,920

[22] Filed: Nov. 7, 1983

[51] Int. Cl.[4] ..... A47F 5/08

[52] U.S. Cl. ..... 211/187; 108/152; 211/90; 211/208; 248/250

[58] Field of Search ..... 211/134, 90, 187, 208; 108/107, 109, 152; 52/36; 248/159, 250, 243, 225.2

[56] References Cited

U.S. PATENT DOCUMENTS

| | | | |
|---|---|---|---|
| Re. 27,200 | 10/1971 | Ferdinand et al. | 248/250 X |
| 2,553,960 | 5/1951 | DeSwart | 248/250 |
| 3,471,112 | 10/1969 | MacDonald et al. | 108/109 X |
| 3,598,064 | 8/1971 | Stempel | 108/42 |
| 3,698,564 | 10/1972 | Muller | 248/159 X |
| 3,759,191 | 9/1973 | Freeman | 108/109 X |
| 3,759,623 | 9/1973 | Hesse | 248/159 X |
| 3,765,634 | 10/1973 | Stempel | 248/250 |
| 3,859,002 | 1/1975 | Sauey | 408/16 |
| 3,892,189 | 7/1975 | Killam | 108/109 |
| 4,159,814 | 7/1979 | Fibus | 248/243 |
| 4,361,099 | 11/1982 | Kokenge et al. | 108/152 |

*Primary Examiner*—Robert W. Gibson, Jr.
*Attorney, Agent, or Firm*—Oltman and Flynn

[57] ABSTRACT

For locating and supporting ventilated shelves in a closet, a pole assembly having vertically spaced shelf support clips on one side, each of which defines a recess which is open at the top for receiving an edge rod on the front of a shelf. When the pole assembly is placed next to a closet wall, the support clips in the pole assembly may be used to locate the positions for wall-mounted support clips for supporting shelves at the back or channel mounts for supporting shelves at one end.

2 Claims, 7 Drawing Figures

FIG. 5
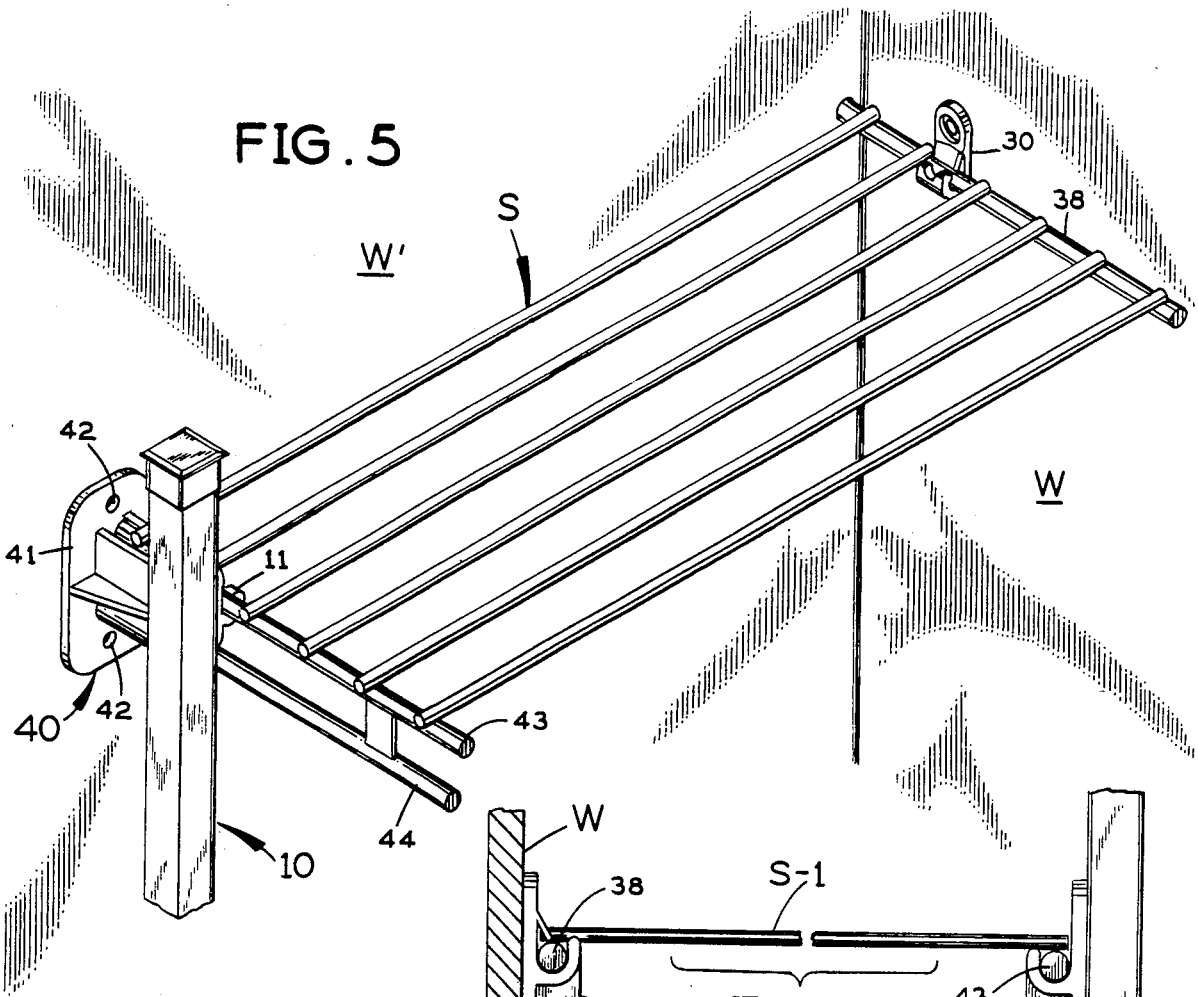
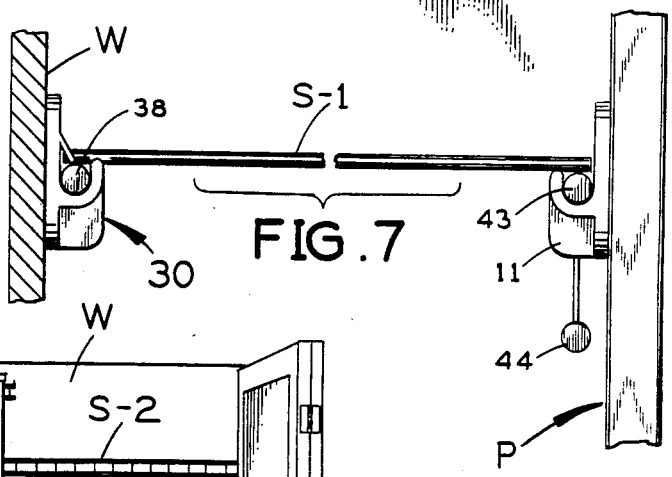
FIG. 7
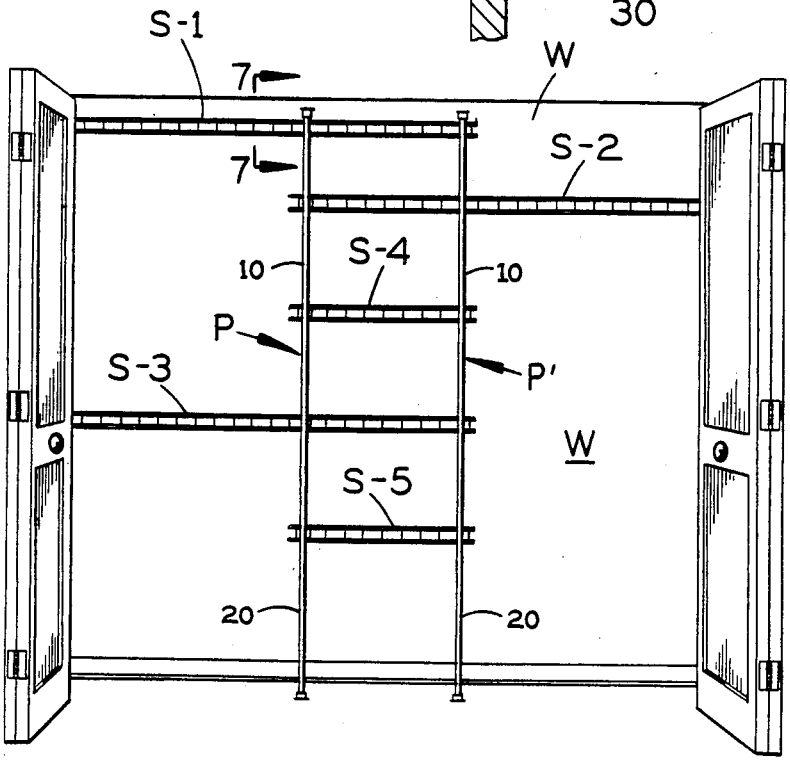
FIG. 6

POLE ASSEMBLY FOR INSTALLING CLOSET SHELVES

This invention relates to a pole assembly for use in locating the positions for shelves in a closet and for supporting those shelves at the front.

Ventilated closet shelves of the type shown in U.S. Pat. No. 3,598,064 to Edward H. Stempel, assigned to the same assignee as the present invention, have come into extensive use to make better use of the available space in the closets. Such shelves come in different lengths and may be mounted at various heights on the closet walls by means of channel mounts as shown in U.S. Pat. No. 3,598,064 and support clips as shown in U.S. patent application Ser. No. 06/323,450, filed Nov. 20, 1981 by Ebb W. Pate and assigned to the same assignee as the present invention. Shelves at the same level in the closet may be connected end-to-end by a joiner support as shown in U.S. Pat. No. 3,765,634 to Edward H. Stempel, assigned to the same assignee as the present invention.

The present invention is directed to a novel pole assembly which may be used, first, to locate the positions on the closet walls for the support clips which will support the longer shelves at the back and the channel mounts which will support those shelves at one end in front. The same pole assembly then may be used as a permanent support for the shelves at the front. Because of its versatility this pole assembly makes it easier to install closet shelves of different lengths at desired locations in the closet to make more efficient use of the storage space available there.

A principal object of this invention is to provide a novel pole assembly for use in locating the positions for wall-mounted support clips and/or channel mounts for closet shelves and also for use as a permanent support for the shelves at the front.

Another object of this invention is to provide such a pole assembly having clips on one side which may be used to locate the wall-mounted support clips and channel mounts for the shelves and then may be used to receive and support the shelves at the front.

Further objects and advantages of this invention will be apparent from the following detailed description of a presently preferred embodiment which is illustrated schematically in the accompanying drawings.

DESCRIPTION OF THE DRAWINGS

FIG. 5 is a perspective view of a closet shelf supported at the back by wall clips as shown in FIG. 4 and at a front corner by a channel mount positioned with the use of the present pole assembly;

FIG. 6 is a front elevation of a closet having shelves mounted on wall clips, channel mounts and clips on two pole assemblies in accordance with this invention; and FIG. 7 is a vertical section taken along the line 7—7 in FIG. 6 and showing how the top shelf is supported at the front and back.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
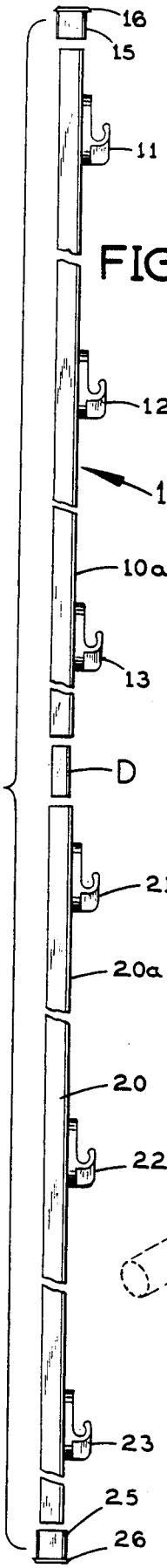
FIG. 1 is an elevational view of a pole assembly in accordance with this invention.
Figure 2:
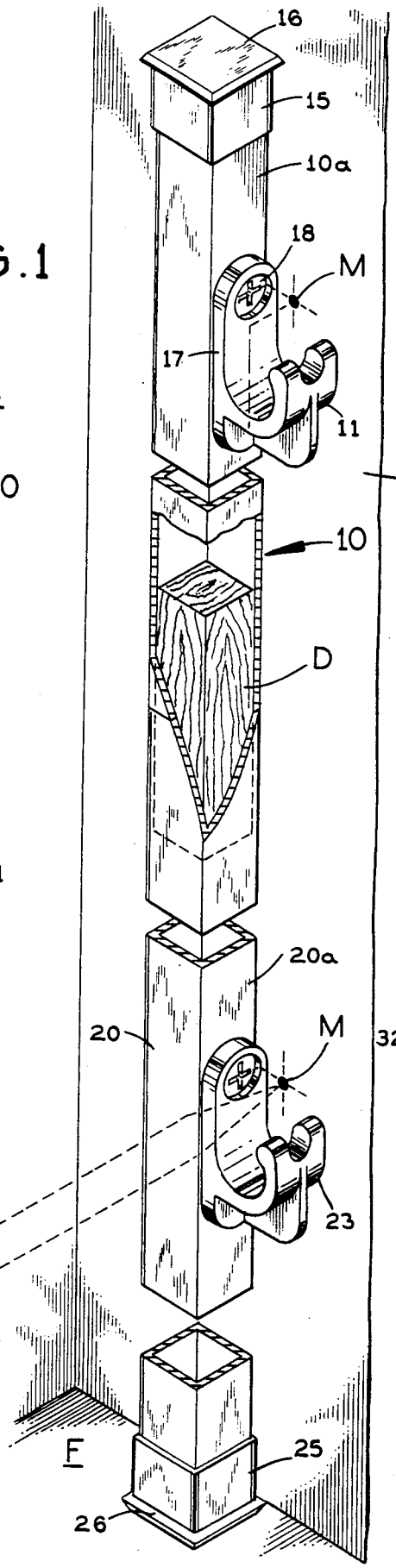
FIG. 2 is an exploded perspective view of this pole assembly, with parts broken away to show details of its construction.

Referring to FIGS. 1 and 2, the pole assembly in accordance with the present invention comprises an upper pole member 10 and a similar lower pole member 20, each of hollow rectangular cross section and each being substantially rigid in compression longitudinally. The upper and lower pole members are connected end-to-end by a complementary wooden dowel D, which fits snugly inside the lower end of the upper pole member and inside the upper end of the lower pole member. As shown, the upper pole member 10 carries three vertically-spaced shelf supporting hooks 11, 12 and 13, each having the shape shown in FIG. 3. Similarly, the lower pole member 20 carries three vertically-spaced shelf support hooks 21, 22 and 23. When the dowel D holds the upper and lower pole members assembled end-to-end, the flat side 10*a* of the upper pole member 10 where the hooks 11, 12 and 13 are located is substantially co-planar with the flat side 20*a* of the lower pole member 20 where the hooks 21, 22 and 23 are located.

The pole assembly also preferably has an upper end cap having a rectangular lower segment 15 which fits snugly over the upper end of the upper pole member and a flat transverse top wall 16 which projects laterally beyond the lower segment 15 on all four sides. A lower end cap 25, 26 which is a mirror image of the upper end cap, fits on the lower end of the lower pole member 20 and is engageable with the closet floor F, as shown in FIG. 2.

Figure 3:
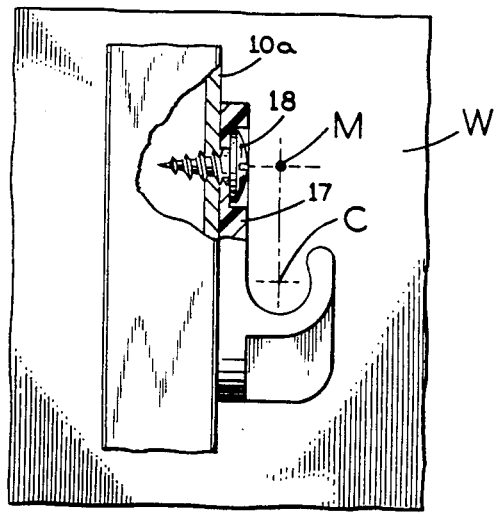
FIG. 3 is a fragmentary elevational view showing one of the clips on this pole assembly positioned next to a closet wall to locate shelf support clips which will be mounted on that wall.

FIG. 2 shows how this pole assembly may be used to locate support clips which are to be attached to a closet wall W to receive and support the back side of shelves in the closet. The pole assembly is positioned so that the side 10*a*, 20*a* from which its support clips 11–13 and 21–23 project extends in a vertical plane perpendicular to the vertical plane of the wall W of the closet on which shelf support clips are to be mounted. Usually, the person using the pole assembly for this purpose will turn the pole so that the pole clips are on the same side of the pole assembly as the person is. As shown in FIG. 2, the person holds the pole assembly flush against the wall and uses a pencil or similar marker to make a visible mark M on the wall at the location of each shelf support clip in the pole assembly. As shown in FIG. 3, each clip on the pole has a flat vertical back wall 17 formed with an opening near its upper end for receiving a screw 18 which fastens it to the flat side 10*a* or 20*a* of the pole assembly. For each clip on the pole assembly the person makes a pencil mark on the wall at M, which is at the same height as the mounting screw 18 and is vertically aligned with the center C (FIG. 3) of the channel on the support clip which will receive a back rail of the shelf.

Figure 4:
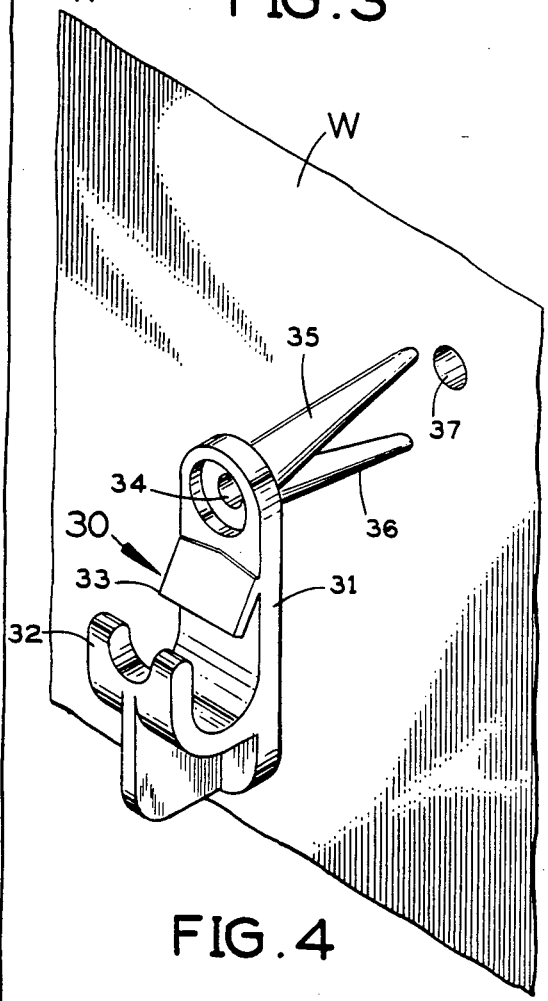
FIG. 4 is a perspective view showing the shelf support clip for attachment to the closet wall where the back of a shelf will be located.

After making such a mark at the vertical position of each shelf support clip in the pole assembly, the user drills a hole in the wall at each mark M and inserts a shelf support clip into that hole, as shown in FIG. 4.

Preferably, this wall-mounted shelf support clip is constructed as disclosed in U.S. patent application Ser. No. 06/323,450 filed Nov. 21, 1980 by Ebb W. Pate and assigned to the same assignee as the present invention. As shown in FIG. 4, the wall-mounted clip 30 has a vertical segment 31 for engagement with the closet wall W, a hook segment 32 in front of the vertical segment 31 and defining with it a recess which is open at the top for receiving the back edge rod of the shelf, a flexible and resilient fin 33 on the front overlying the recess to retain the back edge rod of the shelf in this recess, an opening 34 for receiving a screw and flexible and resilient fingers 35 and 36 on the back on opposite sides of the screw opening 34 which are spread apart by the insertion of the screw into opening 34 to engage the wall W behind its drilled hole 37.

This procedure is repeated at suitable intervals (e.g., 11 inches) across the closet wall W to provide enough support clips 30 on the wall to properly support each shelf along its back edge. As shown in FIG. 5, the shelf S has a horizontal back edge rod 38 which fits snugly in the upwardly-facing recess on the front of each wall-mounted support clip 30. The edge rod 38 is of circular cross-section and the shelf can pivot about the axis of this edge rod while it is in the wall-mounted clips 30 and the shelf is supported only along its back edge by these clips.

Next, the present pole assembly may be used to temporarily support the front end of a shelf and to assist the user to locate wall-attached channel mounts for supporting one end of the shelf at the front. The wall-attached channel mount 40 (FIG. 5) preferably is of the type disclosed in FIG. 2 of U.S. Pat. No. 3,598,064. At this time, the back of the shelf is supported by clips 30 on the closet wall W and the front end of the shelf is supported from below by one of the support clips 11–13 and 21–23 in the pole assembly (which is at the same height as the clips 30 mounted on wall W, so that the shelf is horizontal). The pole assembly is, of course, positioned with its clips 11–13 and 21–23 facing toward wall W. Preferably, the pole assembly is positioned a conveniently short distance from the closet wall W' to which the channel mount 40 is to be fastened.

The channel mount 40 fits slidably on the front of the shelf at one end. It has a flat vertical segment 41 which is held against the closet wall W' while the user makes pencil marks on this wall at the screw holes 42 and 43 in this segment of the channel mount. Since the shelf is held horizontal by the support clips 30 in wall W and the corresponding support clip in the pole assembly, and the channel mount 40 slidably engages the end of the shelf, these pencil marks determine the correct positions for screws to be inserted through these openings 42 and 43 in the segment 41 of the channel mount to affix it to the closet wall W'.

FIG. 6 shows three relatively long shelves S-1, S-2 and S-3 in the closet, each of which is supported from two walls of the closet. Shelf S-1 is supported along the back by clips 30 on wall W and at its left front corner by a channel mount 40 on the left wall of the closet as shown in FIG. 5. Shelf S-3 is supported the same way. Shelf S-2 is supported along the back by clips 30 on wall W and at its right front corner by a channel mount 40 on the right wall of the closet.

Next, a pole assembly P (FIG. 6) of the type shown in FIGS. 1 and 2 is positioned at the front of the long shelves S-1, S-2 and S-3 almost midway across the closet wall W. The shelf support clips 11–13 and 21–23 on this pole assembly project toward closet wall W.

Pole clip 11 is at the same height as the wall clips 30 and the channel mount 40 which support shelf S-1, so this pole clip supports the front of shelf S-1 toward its right end. As shown in FIG. 5 the shelf has upper and lower horizontal front edge rods 43 and 44. The upper front rod 43 of the shelf is at the same height as is back edge rod 38, so the clip 11 on pole assembly P will receive rod 43 and support it from below, as shown in FIG. 7.

Clip 12 on pole assembly P is at the same height as the wall clips 30 and the channel mount 40 which support shelf S-2, and this pole clip supports shelf S-2 very near its left end in the manner already described for shelf S-1.

Clip 21 on pole assembly P is at the same height as the wall clips 30 and the channel mount 40 which support shelf S-3, and this pole clip supports shelf S-3 toward its right end in the same manner as described for shelf S-1.

Next a short shelf S-4 is mounted at the back on wall clips 30 which are at the same height as clip 13 on pole assembly P. Shelf S-4 extends slightly to the left of pole assembly P and at the front near this end it is supported from below by clip 13 on this pole assembly. The length of shelf S-4 is such that it is supported by three clips 30 on closet wall W, for example.

Next, another short shelf S-5 is mounted at the back on wall clips 30 which are at the same height as clip 22 on pole assembly P. Shelf S-5 extends slightly to the left of pole assembly P and at the front near this end it is supported from below by clip 22 on pole assembly P.

Finally, a second pole assembly P' (FIG. 6) is positioned at the front of the shelves to the right of pole assembly P. All five shelves are snapped into the respective clips 11, 12, 13, 21 and 22 on pole assembly P'.

With this arrangement the long shelves S-1 and S-3 are supported at suitably close intervals along the back by clips 30 on closet wall W, at the left front corner by respective channel mounts 40 on the adjacent closet wall, near the right front corner by clips 11 and 21, respectively, on pole assembly P', and toward the middle at the front by clips 11 and 21, respectively, on pole assembly P. Long shelf S-2 is supported along the back by clips 30 on closet wall W, at the right front corner by a channel mount 40 on the adjacent closet wall, near the left front corner by clip 12 on pole assembly P, and toward the middle at the front by clip 12 on pole assembly P'. Short shelf S-4 is supported along the back by clips 30 on wall W and near its front corners by clips 13 on pole assemblies P and P'. Short shelf S-4 is supported along the back by clips 30 on wall W and near its front corners by clips 22 on pole assemblies P and P'.

If desirable, one or all of the long shelves S-1, S-2 and S-3 may be supported by a brace attached to wall W and located about midway between its channel mount 40 at one end and the closer pole assembly P or P'.

A shoe rack or additional shelves may be supported by clips on wall W, clips on one or both pole assemblies P and P', and a channel mount 40 in the manner already described.

What is claimed is:

1. A pole assembly for locating and supporting shelves in a closet comprising:

a substantially rigid, vertically elongated pole structure;

and a plurality of shelf support clips attached to said pole structure at vertically spaced positions along one side, each of said clips defining a recess which is open at the top for receiving an edge rod on the front of a shelf;

said pole assembly being adapted to be positioned against a wall of the closet with said one side of the pole structure extending perpendicular to the wall to position each of said clips along the wall for the insertion of a pencil or the like to mark the position on the wall for the attachment of a wall-mounted shelf support clip;

said pole assembly being adapted to be positioned away from said wall of the closet with said one side of the pole structure facing toward said wall and positioing said clips in the pole assembly to hold the outer end of shelves whose inner ends are in support clips on said wall;

said pole structure comprising:

upper and lower vertically elongated pole members of hollow rectangular cross-section extending end-to-end in vertical alignment;

and a dowel received snugly in the adjoining ends of said pole members and holding them end-to-end in alignment.

2. A pole assembly according to claim 1 wherein:

each of said shelf support clips attached to said pole structure has a flat vertical segment engaging said one side of the pole structure and an outwardly and upwardly curved segment extending from said vertical segment and defining therewith said recess for receiving an edge rod on the front of a shelf.

* * * * *